US010099113B2

(12) United States Patent
Kris

(10) Patent No.: US 10,099,113 B2
(45) Date of Patent: Oct. 16, 2018

(54) GAMES

(71) Applicant: Kris Kris, Bath (GB)

(72) Inventor: Kris Kris, Bath (GB)

( * ) Notice: Subject to any disclaimer, the term of this patent is extended or adjusted under 35 U.S.C. 154(b) by 0 days.

(21) Appl. No.: 15/593,815

(22) Filed: May 12, 2017

(65) Prior Publication Data

US 2017/0326440 A1 Nov. 16, 2017

(30) Foreign Application Priority Data

May 14, 2016 (GB) ..... 1608498

(51) Int. Cl.
*A63F 3/00* (2006.01)

(52) U.S. Cl.
CPC ..... *A63F 3/00214* (2013.01); *A63F 3/00097* (2013.01); *A63F 3/00574* (2013.01); *A63F 2003/0022* (2013.01); *A63F 2003/00621* (2013.01); *A63F 2003/00747* (2013.01); *A63F 2003/00835* (2013.01)

(58) Field of Classification Search
CPC . A63F 3/00214; A63F 3/0097; A63F 3/00574
See application file for complete search history.

(56) References Cited

U.S. PATENT DOCUMENTS

| | | | | |
|---|---|---|---|---|
| 1,472,536 A | | 10/1923 | Thomson | |
| 2,801,107 A | * | 7/1957 | Greer, Jr. ..... | A63F 3/00094 273/241 |
| 3,510,962 A | | 5/1970 | Kazuhisa Sato | |
| 3,751,039 A | | 8/1973 | Dykoski | |
| 2008/0042361 A1 | | 2/2008 | Park | |

FOREIGN PATENT DOCUMENTS

| | | |
|---|---|---|
| GB | 1354521 | 5/1974 |

* cited by examiner

*Primary Examiner* — Michael Dennis
(74) *Attorney, Agent, or Firm* — Ware, Fressola, Maguire & Barber LLP

(57) ABSTRACT

A game comprises a matrix that includes a central core and a plurality of stems emanating from the central core, with the lengths of the stems and the orientations of the stems such that the outer ends (or terminals) of the stems are on the surface of a cube, and playing pieces for attachment to the outer ends (or terminals) of the stems.

5 Claims, 5 Drawing Sheets

GAMES

CROSS-REFERENCE TO RELATED APPLICATION

This application claims priority under 35 USC § 119 to British Patent Application No. 1608498.0 filed on May 14, 2017, which application is hereby incorporated by reference in its entirety.

TECHNICAL FIELD

This invention relates to games and, in particular, to a game in which the playing strategy is of particular significance.

It is an object of the present invention to provide improved means for playing a game.

It is also an object of the present invention to provide a novel method of playing a game.

SUMMARY OF THE INVENTION

According to a first aspect of the present invention there is provided a game comprising a matrix that includes a central core and a plurality of stems emanating from the central core, with the lengths of the stems and the orientations of the stems such that the outer ends (or terminals) of the stems are on the surface of a cube, and playing pieces for attachment to the outer ends (or terminals) of the stems.

There are preferably twenty-six stems emanating from the central core with the stems symmetrically disposed so that, on each square face of the cube, there are nine stem terminals, with three stem terminals on each side of the square and one terminal at the centre of the square.

Each person playing the game has a plurality of playing pieces that are preferably of a different colour from those of the other players. The playing pieces may, be, for example, spheres formed with sockets into which the ends of the stems are a close fit. The playing pieces may alternatively be in the form of cylinders that are closed at one end.

The ends of the stems may alternatively be externally threaded with the sockets of the playing pieces having mating thread formations. Alternatively, the playing pieces may include projections that can be fitted into sockets at the outer ends of the stems.

According to a second aspect of the present invention there is provided a method of playing a game which includes providing a matrix that includes a central core and a plurality of stems emanating from the central core, with the lengths of the stems and the orientations of the stems such that the outer ends (or terminals) of the stems are on the surface of a cube, providing a plurality of playing pieces for attachment to the outer ends (or terminals) of the stems, deciding on an order of play, and taking turns to attach the playing pieces to the terminals, with the winner of the game being the first player to form a straight line containing three playing pieces.

The rules are preferably such that if, by the time that the players have used twenty-six playing pieces, none of the players has managed to form a straight line containing three playing pieces, the central core will be regarded as a playing piece of the player whose turn is next and this player will be regarded as the winner of the game if the central core is on a straight line joining any two of that player's pieces.

DESCRIPTION OF THE PREFERRED EMBODIMENT

Figure 1:
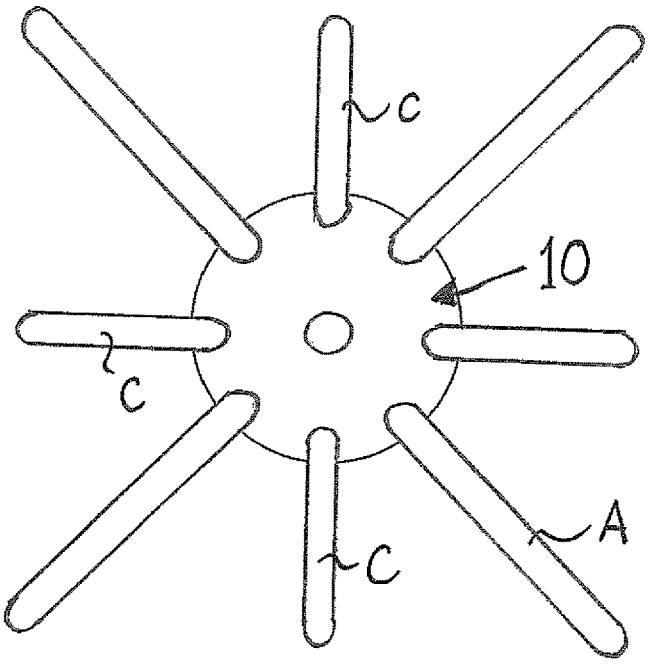
FIG. 1 is a top, bottom and side elevation of the core with the stems attached.
Figure 2:
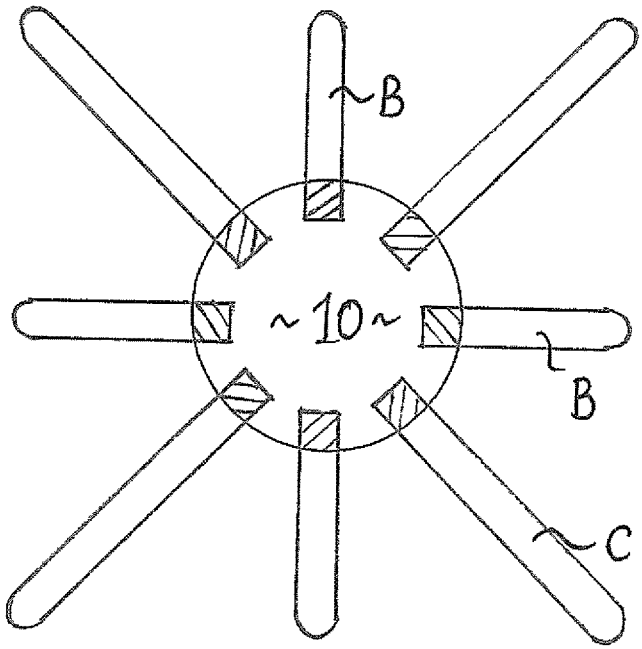
FIG. 2 is a sectional view through the centre of the core.
Figure 3:
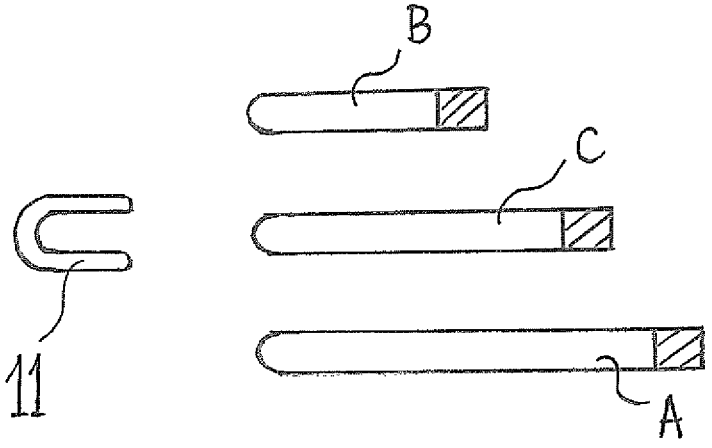
FIG. 3 shows the stems and playing pieces.
Figure 4:
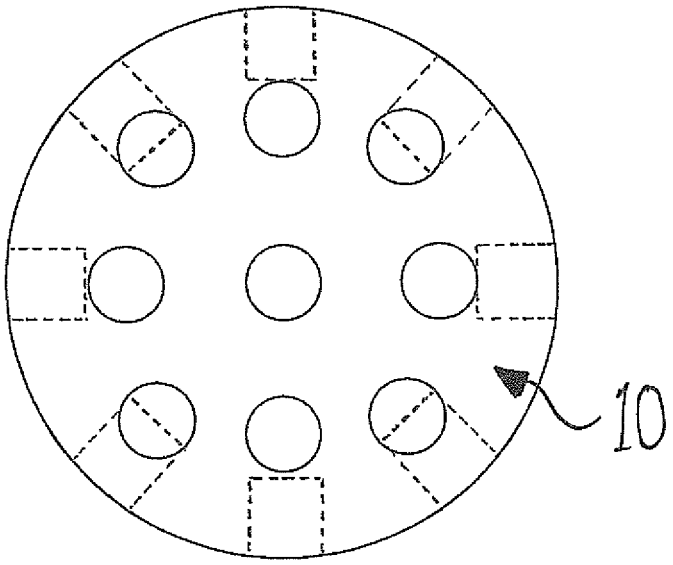
FIG. 4 is a top, bottom and side elevation of the core.
Figure 5:
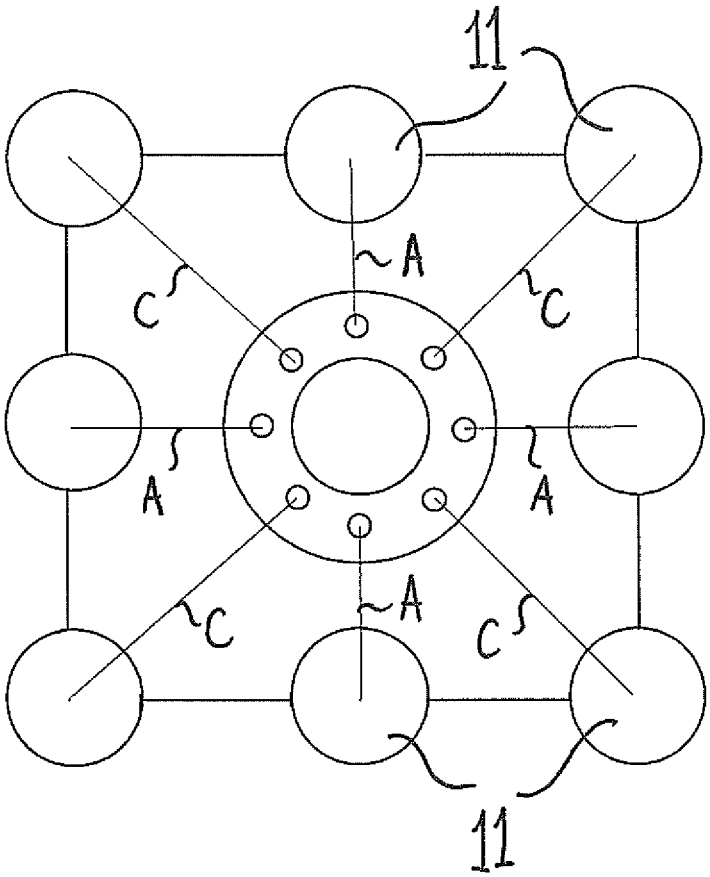
FIGS. 5, 6 and 7 are diagrammatic views showing all the playing pieces attached to the ends of the stems.
Figure 6:
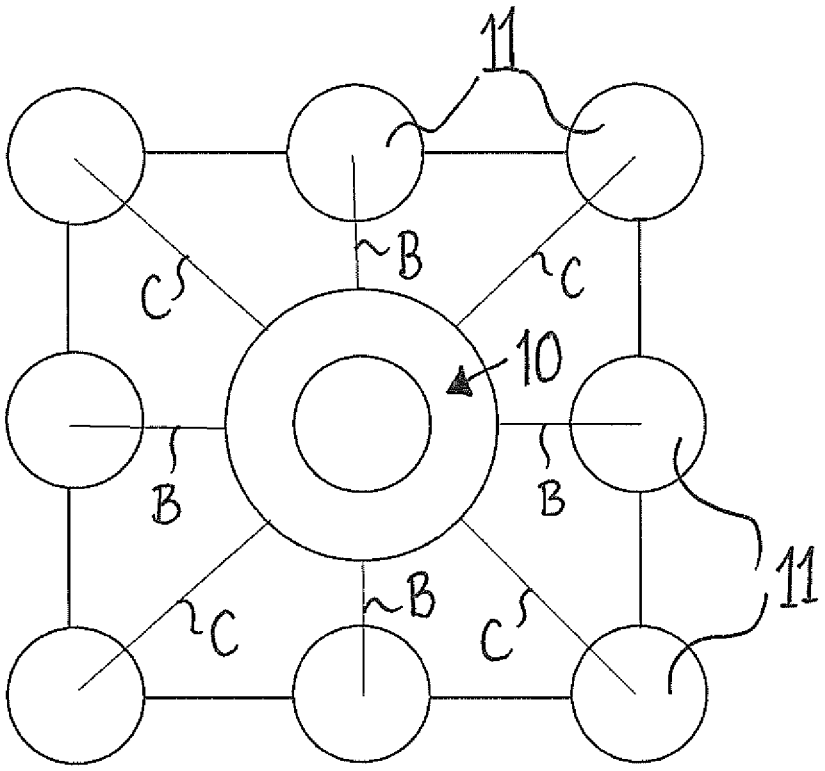
Figure 7:
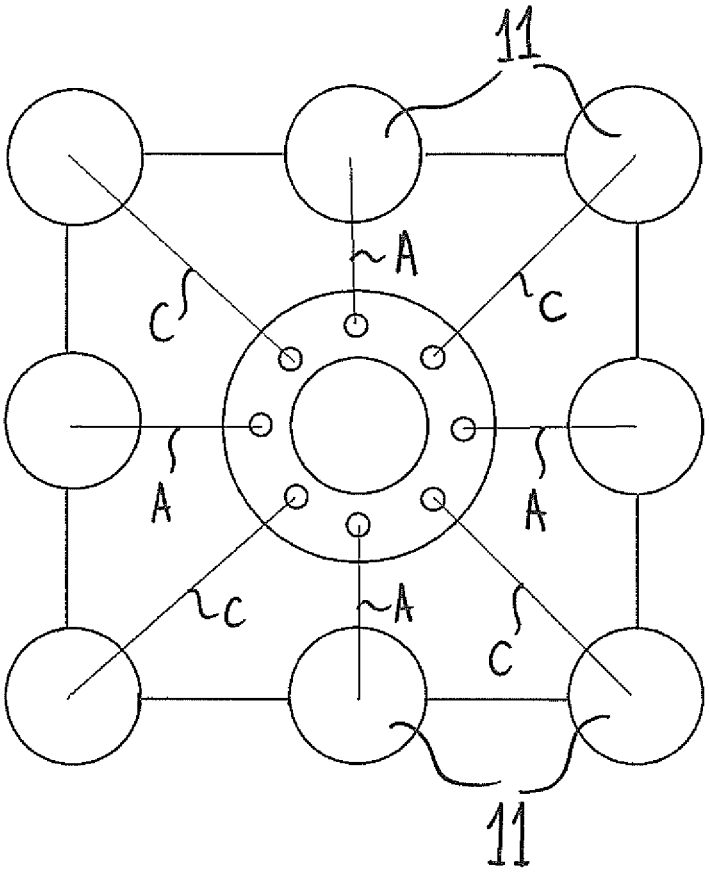

The means for playing a game includes a central spherical core 10 of metal or plastic and twenty-six rods A, B and C extending from the core 10 with the orientations and the lengths of the rods A, B and C such that the outer ends or terminals of the rods A, B and C are so positioned that they are located on the surfaces of a regular cube. In one specific embodiment, each of the eight longest rods A has a length of 2.60 inches, each of the six shortest rods B has a length of 0.99 inches, and each of the mid-size rods C has a length of 2.03 inches. Thus each rod A has a length 2.62 times the length of each rod B, and each rod C has a length 2.05 times the length of each rod B.

The lengths of the rods A, B and C and the positioning thereof are such that there are nine terminals on each of the square faces of the cube. The rods A, B and C can be of metal or plastic. In one example, the core 10 is formed with twenty six internally threaded sockets and the rods A, B and C are formed with corresponding threaded end formations so that they can be fitted releasably in the sockets of the core 10.

The game is played by three players each of whom has nine playing pieces 11 and the playing pieces 11 are of three different colours, for example, red, white and blue or green, white and orange. The playing pieces 11 are formed of a reasonably resilient plastics material and are in the form of cylinders that are closed at one end. The diameters of the bores of the cylindrical playing pieces 11 are such that they can be fitted over the ends of the rods A, B and C and will remain in position.

The three players decide on the set of playing pieces 11 which they are to use and on the order of play. The object of the game is to obtain a line of three pieces of the same colour on any one of the faces of the matrix, with the winner of the game being the first player to form a straight line containing three playing pieces 11. The playing pieces 11 can be placed on the top, bottom or a side of the matrix when it is each players turn.

The rules are such that if, by the time that the players have used twenty-six playing pieces 11, none of the players has managed to form a straight line containing three playing pieces 11, the central core 10 will be regarded as a playing piece of the player whose turn is next and this player will be regarded as the winner of the game if the central core is on a straight line joining any two of that player's pieces.

It is also possible for the three players to collude with a view to producing a tie, i.e. one in which, even with the central core, there is no straight line joining all three playing pieces 11 of one colour. A person playing on their own could also play in this way using all three colours of the playing pieces.

To increase the complexity of the game, it is possible to give the players the opportunity to declare "TAT!", i.e. "Take a Turn". If a player declares "TAT!" he or she turns the matrix through ninety degrees and the player whose turn is next is then not allowed to play on any one of the terminal points on the bottom of the matrix. Taking a Turn changes which player has the last move.

The game can be played with a timer to create a degree of urgency or any atmosphere of panic, giving each player only a number of seconds to take their turn.

What is claimed is:

1. A game comprising a matrix that includes a central core and a plurality of stems emanating from the central core, with lengths of the stems and orientations of the stems such that outer ends or terminals of the stems are on a surface of a cube, and playing pieces for attachment to the outer ends or terminals of the stems, in which there are twenty-six stems emanating from the central core with the stems symmetrically disposed so that, on each square face of the cube, there are nine stem terminals, with three stem terminals on each side of the square and one terminal at the centre of the square.

2. The game as claimed in claim 1, in which each person playing the game has a plurality of playing pieces that are of a different colour from those of the other players.

3. The game as claimed in claim 2, in which the playing pieces are in the form of cylinders that are closed at one end.

4. The game as claimed in claim 1, in which each person playing the game has a plurality of playing pieces that are of a different colour from those of the other players.

5. The game as claimed in claim 1, in which the playing pieces are in the form of cylinders that are closed at one end.

* * * * *